US005113325A

United States Patent [19]

Eisenbraun

[11] Patent Number: 5,113,325

[45] Date of Patent: May 12, 1992

[54] LIGHT ASSEMBLY KIT FOR ILLUMINATING AN ARTICLE OF CLOTHING

[76] Inventor: Kenneth D. Eisenbraun, 1047 Pilgrim, Birmingham, Mich. 48009

[21] Appl. No.: 739,299

[22] Filed: Aug. 1, 1991

[51] Int. Cl.[5] ..... F21L 15/08

[52] U.S. Cl. ..... 362/103; 362/252; 362/800; 362/806

[58] Field of Search ..... 362/103, 104, 108, 230, 362/231, 234, 249, 251, 252, 800, 806, 808; 40/586, 550, 442, 152.2

[56] References Cited

U.S. PATENT DOCUMENTS

| | | | |
|---|---|---|---|
| 2,760,052 | 8/1956 | Owen | 362/252 |
| 3,737,647 | 6/1973 | Gomi | 362/800 |
| 4,164,008 | 8/1979 | Miller et al. | 362/103 |
| 4,367,515 | 1/1983 | Beard | 362/103 |
| 4,480,293 | 10/1984 | Wells | 362/108 |
| 4,602,191 | 7/1986 | Davila | 362/800 |
| 4,709,307 | 11/1987 | Branom | 362/103 |
| 4,774,434 | 9/1988 | Bennion | 362/103 |
| 4,774,642 | 9/1988 | Janko et al. | 362/108 |
| 4,823,240 | 4/1989 | Shenker | 362/103 |
| 4,882,865 | 11/1989 | Andeweg | 40/442 |
| 5,019,438 | 5/1991 | Rapisarda | 362/800 |

FOREIGN PATENT DOCUMENTS

| | | | |
|---|---|---|---|
| 2538587 | 6/1984 | France | 40/550 |

*Primary Examiner*—Ira S. Lazarus
*Assistant Examiner*—Y. Quach
*Attorney, Agent, or Firm*—Krass & Young

[57] ABSTRACT

A light illuminating kit assembly 12 is installable on a garment 10 for illuminating and enhancing a graphics illustration 16 as printed on the exterior surface of the garment 10. The kit assembly includes a central actuation unit 26 having a plurality of wires 24 connecting the central actuation unit with a plurality of light emitting diodes 20. The central actuation unit has a control circuit 30 and a power supply 32 connected thereto via a switch 35. The LED's, when installed through apertures in the shirt, can be flashed ON and OFF in a desired pattern to enhance the illustrations 16.

12 Claims, 2 Drawing Sheets

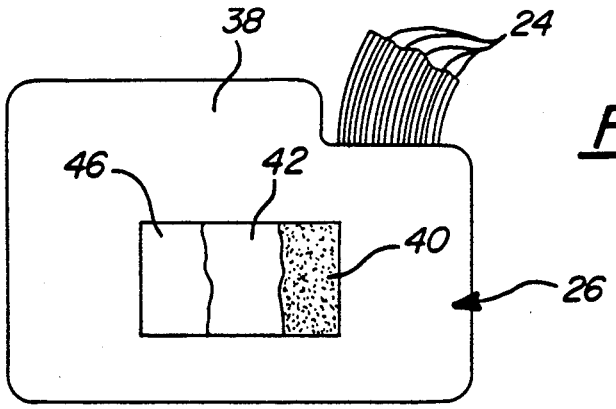
FIG-3
FIG-4
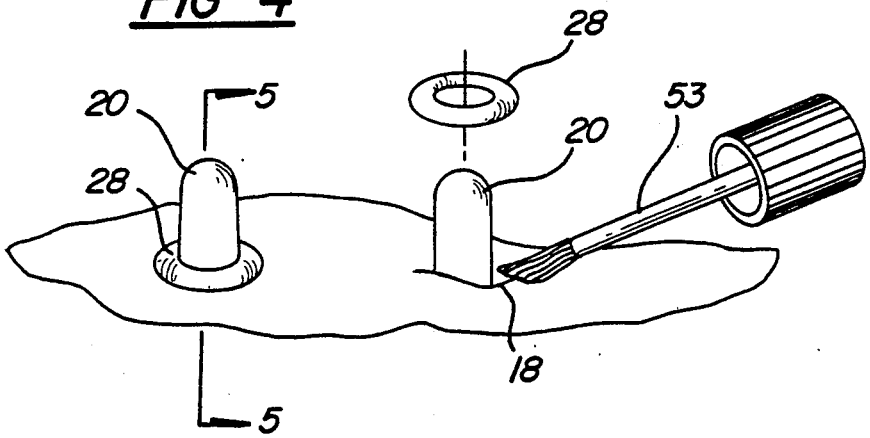
FIG-5
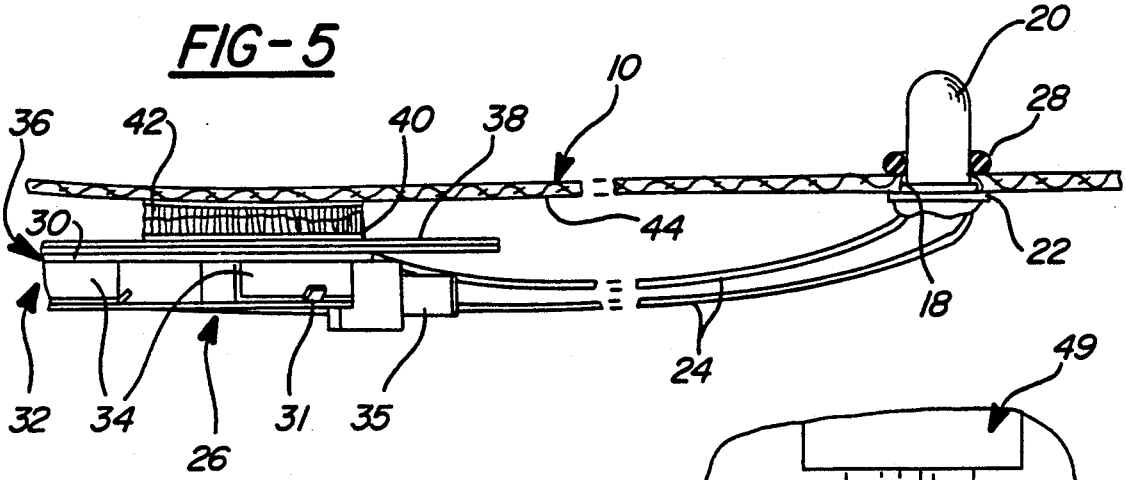
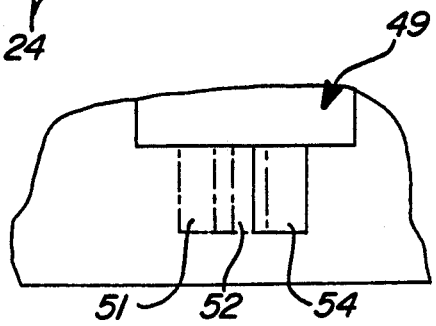
FIG-6

LIGHT ASSEMBLY KIT FOR ILLUMINATING AN ARTICLE OF CLOTHING

TECHNICAL FIELD

This invention relates to a light assembly kit including a plurality of light emitting diodes that can be affixed and mounted on articles of clothing.

BACKGROUND OF THE INVENTION

The miniaturization of electronic circuitry and the reduction in size of light source elements have made it possible to place light illuminating devices on articles of clothing to provide for illuminated embellishments incorporated into a pattern or design on the clothing article. Often these light illumination devices include a flexible circuit board such as shown in U.S. Pat. No. 4,480,293 issued to Wells on Oct. 30, 1984. Other articles of clothing embellishments can include a central module that produces audio tones synchronized with the flashing of light emitting diodes as shown in U.S. Pat. No. 4,823,240 issued to Shenker on Apr. 18, 1989. The flashing of light emitting diodes can also be arranged to provide for an illusion of motion as disclosed in U.S. Pat. No. 4,882,865 issued to Andeweg on Nov. 28, 1989.

Presently, garments with light emitting embellishments either have the light emitting diodes mounted on flexible circuit boards or mounted to wires that extend from one light emitting diode to another light emitting diode. These assemblies constrain the position of the light emitting diodes with respect to one another and with respect to the central actuating unit. This constraint is acceptable when the light emitting diode assemblies are made for a specific pattern and the garment with a specified light pattern is assembled in a factory. However, when a person at home would like to install light emitting diodes on an individual shirt with a unique pattern these circuit boards and assemblies with wires leading from one LED directly to another LED can unduly limit the choice of designs which the assemblies can provide. Secondly, the installation of known light emitting diode assemblies are unduly complex for home assembly.

What is needed is a light emitting embellishment kit for garments and the like wherein each light emitting diode is independently wired to a central actuating unit. What is also needed is a light emitting diode assembly that is in a kit form that can easily be installed onto the garment.

SUMMARY OF THE INVENTION

According to one aspect of the invention, the light illuminating display kit for use with a garment or an article of clothing having sheet material includes a plurality of light emitting elements constructed to protrude through respective holes in the sheet material. A plurality of securement elements secure the light emitting elements in place once the elements are positioned through the hole. Preferably each light emitting element is a light emitting diode. Each light emitting diode is connected to a central electronic actuation unit that controls the time of actuation for each light emitting diode.

A plurality of flexible wires electrically connect each of the light emitting diodes directly with the central electronic actuation unit such that each light emitting diode is independently actuated by the central actuation unit. The electronic actuation unit has a power supply such as several disc type batteries for powering the light emitting diodes. Desirably, the actuation unit includes a flat circuit board and disc type batteries affixable to the flat circuit board that are housed in a relatively thin flat, soft-sided case. Preferably, the thin case can be removably affixed to an inside surface of the clothing article via a fastener. Desirably, this fastener includes a hook and loop fastening system such as VELCRO® which has one-half of the fastener affixed to the soft-sided case and the other half of the fastener affixed to the sheet material of the clothing article such that the electronic actuation unit can be easily mounted and dismounted onto the sheet material.

It is desirable that the actuation unit has a switch for actuating and deactuating the actuation unit. Preferably a multi-position switch is incorporated to actuate the actuation unit from the OFF mode to either a flashing mode or a continuously ON mode. Preferably the wires that connect the light emitting diodes to the central actuation unit are substantially the same length.

BRIEF DESCRIPTION OF THE DRAWINGS

Reference now is made to the accompanying drawings in which:

FIG. 3 discloses an elevational view of the central actuation unit with a fastener affixed thereto;

FIG. 4 is a partially schematic view illustrating the installation of the LED to the garment;

FIG. 5 is a cross-sectional view taken along the lines 5—5 shown in FIG. 4; and FIG. 6 is a enlarged view of a alternate switch which can be incorporated into the central actuation unit.

DETAILED DESCRIPTION OF THE PREFERRED EMBODIMENTS

Figure 1:
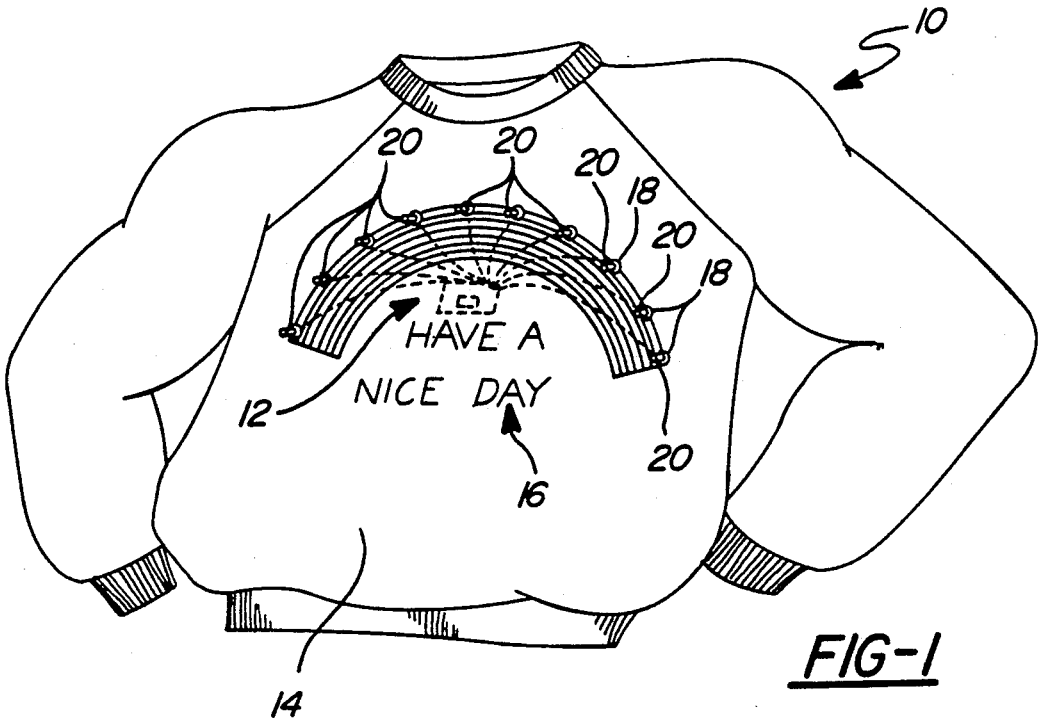
FIG. 1 is a front perspective view of a shirt affixed with the light emitting diode (LED) assembly kit according to the invention.

Referring first to FIG. 1, a garment 10 such as a sweatshirt has a light illuminating kit assembly 12 installed thereto. The shirt 10 has a front portion 14 provided with an artistic illustration 16. The illustration depicted in FIG. 1 shows a rainbow with the slogan "Have a Nice Day." This illustration is only one example from a myriad of other possible illustrations or logos. The front 14 of the shirt 10 has a plurality of light emitting diodes 20 incorporated at desired locations of the illustration 16.

Figure 2:
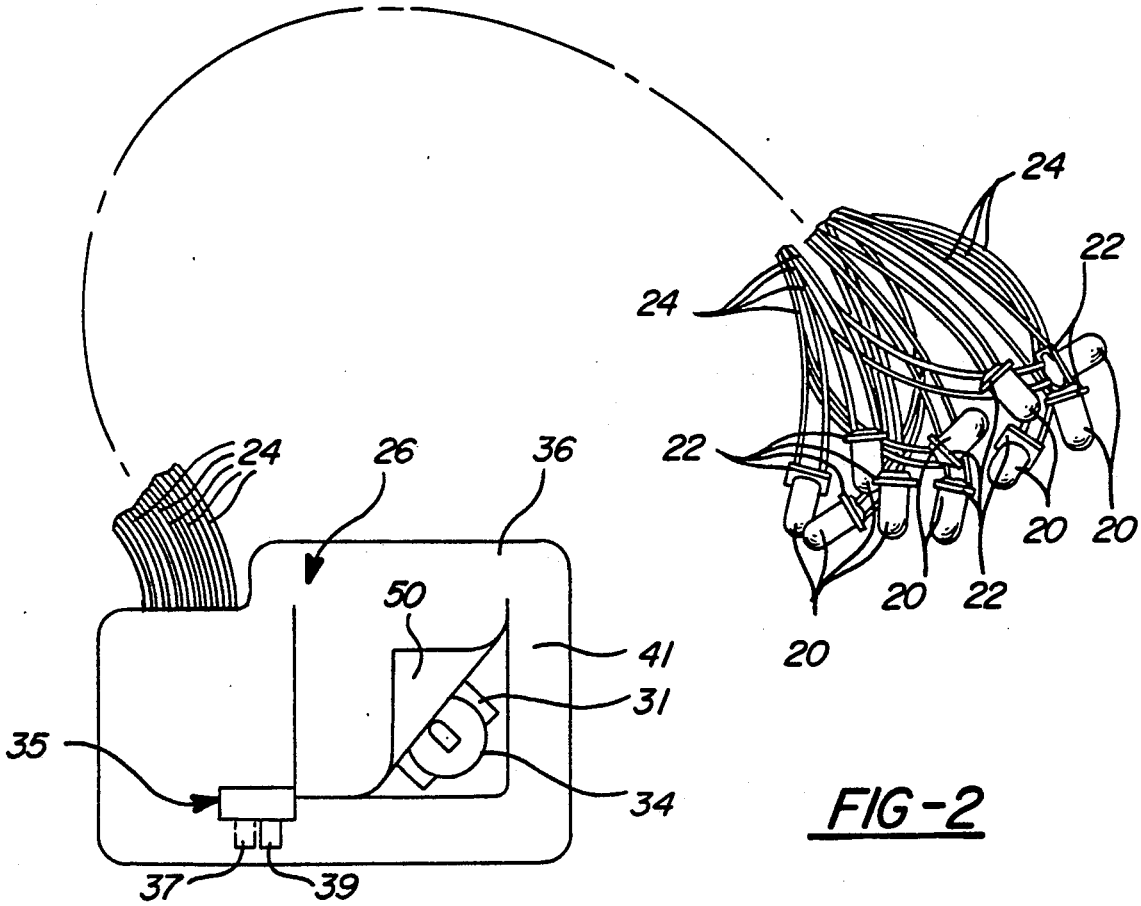
FIG. 2 is a plan view of the light emitting diode assembly kit shown in FIG. 1 with the case partially opened.

Referring now to FIG. 2, each light emitting diode 20 is affixed to a rectangular base 22. The diode is operably connected to a pair of single strand electrical wires 24 which makes an electric circuit between the LED and a central actuating unit 26. A single length of double strand electrical wire may be a suitable substitute for the pair of single strand electrical wires 24. Each LED is connected to the central actuation unit 26 with electrical wire 24 of approximately equal length. The kit 12 includes a rubber O-ring 28 for each LED 20. The rubber O-ring 28 is sized to frictionally engage onto the LED 20.

The central actuation unit 26 includes a pre-programmed control circuit board 30 to actuate and deactuate each LED 20. The control circuit board 30 mounts a plurality of disc type watch batteries 34 or their equivalent to form power supply 32. The watch batteries 34 are mounted such that they lay substantially flat against circuit board 30. Cages 31 acting as one terminal entrap the batteries 34 against board 30 and are in communication with one terminal of the battery. The board 30 has a second terminal (not shown) that abuts the second terminal of the battery 34. The battery 34 can be slidably removed from cage 31. Preferably the control circuit board 30 can actuate each LED 20 at a different time for a predetermined amount of time such that any given instant only one LED is illuminated. Other control circuits can be incorporated to flash all the LED simultaneously, in pairs, or actuate the diodes in any other pattern. The structure of the control circuit board 30 to control the timing and sequence of the flashing LED's are well known in the prior art and can be, depending on the desired actuation pattern, easily programmed.

The central actuation unit 26 has a slide switch 35 movable to an OFF position 37 and ON position 39. When the switch is in the ON position, the power supply 32 is operably connected to the control circuit to actuate the LED's. The switch 35 is mounted to the same side of circuit board 30 as cages 31. The power supply 32 and control circuit board 30 are housed in a relatively thin soft-sided case 36. A side 38 of case 36 has a VELCRO® fastener patch 40 affixed thereto. As best shown in FIG. 5, a complementary VELCRO® patch 42 is affixable to the inside surface 44 of shirt 10 such that the central actuation unit 26 is easily mounted and dismounted thereto.

The VELCRO® patch 42 has an adhesive backing 46 that can merely adhere to the inside surface 44 of the shirt. Alternatively, the patch 42 can be sewn in place. VELCRO® fastener patch 40 similarly has an adhesive backing (not shown) that adheres to the side 38 of soft-sided case 36.

The other side 41 of case 36 has a flap 50 which provides access to the disc watch batteries 34. The watch batteries, when they are depleted can be replaced with fresh similar sized watch batteries.

The installation of the light illuminating kit assembly 12 commences with the desired placement of actuation unit 26 and apertures 18. The apertures 18 may be formed by slits cut into the garment 10 and opened up to receive diodes 20. The apertures 18 must be positioned within the distance defined by the length of wire 24 extending from the central actuation unit 26. As long as all the LED's are within the said defined distance from the central actuation unit 26, the position of one LED does not constrain the position of any other LED. Furthermore, if only several of the LED's are desired to be visible in the design illustration 16 not all the LED's must be placed through a respective hole 18.

For each hole 18, an LED 20 is positioned therethrough as shown in FIG. 4. A clear fingernail polish may be applied by applicator 53 about the apertures 18 after the LED is inserted to prevent fraying of the fabric of shirt 10. The rubber O-ring 28 is then slid over the LED and pushed down firmly such that there is no gap between the base 22, shirt 10 and O-ring 28 as illustrated in FIG. 5.

The VELCRO® patch 42 is then positioned on the inside surface of the shirt inside surface 44 of shirt 10 and the central actuation unit 26 is then mounted onto the VELCRO® patch 42 via VELCRO® fastener patch 40. The soft side relatively flat case 36 is positioned such that its flat side 38 abuts against the inside surface 44 of the shirt and can be used without causing a protrusion on the shirt 10 or be otherwise visible.

After installation, the light illumination kit assembly is operated by the movement of the switch 35 from its OFF position 37 to its ON position 39.

FIG. 6 discloses a second alternate switch 49 having an OFF position 51, a flashing position 52 and a third position 54. Position 52 provides for the control circuit 30 to flash the LED's in the desired above-described manner. The position 54 provides that all the LED's are constantly ON. Alternatively, the third position 54 can provide for a second actuating pattern, for example, all the LED's flash OFF and ON simultaneously.

The main parameters that defines the position of the LED's are position of the central actuation unit 26 and the length of wires 24. Since each LED is not directly connected to any other LED, there are no further constraints on the position of an LED once the position of the central actuation unit is chosen. The central actuation unit may be attached against the inside surface of the shirt via a VELCRO® fastener system. In this way, a person may use the LED kit assembly 12 to embellish and graphically enhance his illustration 16 in any desired fashion and easily wear the assembly inside the shirt 10.

Other variations and modifications of the present invention are possible without departing from its scope and spirit as defined by the appended claims.

The embodiments of the invention in which an exclusive property or privilege is claimed are defined as follows:

1. A light illuminating kit for use with an article of clothing having a plurality of apertures formed therein by a user of said kit, said apertures forming a pattern preselected by said user, said kit comprising:

a plurality of light emitting elements constructed to protrude through respective apertures in said article of clothing;

a plurality of securement elements for securing said light elements to said article of clothing;

a central electronic control unit for controlling the actuation of each of said light elements;

a plurality of flexible wire pairs, each of a predetermined length and each independently wiring only one of said light elements to said central electronic control unit such that said one light element may be moved independently of one of any other of said plurality of light elements such that said any one light element is interchangeably insertable through any one of said plurality of apertures to illuminate said user preselected pattern when said plurality of light elements is actuated.

2. An illuminating light element kit as defined in claim 1 wherein said control unit has a fastener attached thereto for securing said control unit to an inside surface of said article of clothing.

3. An illuminating light element kit as defined in claim 1 further comprising an actuation switch operably mounted to said control unit for actuating and deactuating said control unit and said light emitting elements.

4. An illuminating light element kit as defined in claim 3 wherein said switch is a multi-position switch for actuating said control unit in a selected one of a plurality of different actuating modes.

5. An illuminating kit as defined in claim 4 wherein one of said plurality of actuating modes flashes various ones of said plurality of light emitting elements on at different times and another of said plurality of actuating modes maintains said light emitting elements constantly on.

6. A light illuminating kit as defined by claim 1 wherein the preselected length of each of said flexible wire pairs is substantially equal.

7. A light illuminating kit as defined in claim 1 wherein said control unit flashes said plurality of light emitting elements on and off at periodic time intervals.

8. A light illuminating kit as defined in claim 1 wherein said light emitting elements are light emitting diodes; and said kit further comprises a power supply mounted to said control unit and in electrical communication therewith.

9. A light illuminating kit as defined in claim 8 wherein said power supply includes at least one removable battery, said control unit being receivable in a soft-sided case, said case having a fastener attached thereto for securing said case to an inside surface of said article of clothing.

10. A light illuminating kit as defined in claim 9 wherein said control unit further includes a substantially flat circuit board, said at least one battery being mounted thereto such that when said control unit is inserted into said case, said case presents a substantially flat profile.

11. The kit of claim 1 wherein each of said plurality of securement elements compresses a resilient O-ring configured to retain a portion of one of said light emitting elements therein.

12. A device for forming a plurality of illumination patterns on an outer surface of a piece of flexible sheet material, said device comprising:

a plurality of light emitting elements configured to be removably mountable on said surface;

a central control unit for controlling the actuation of each of said plurality of light elements;

a plurality of flexible wire pairs, each of a fixed length and each independently wiring only one of said plurality of light elements to said central control unit such that said one light element may be moved independently of one of any other of said plurality of light elements such that said plurality of light elements may be arranged on said surface to form any of said plurality of patterns.

* * * * *

US005113325A

REEXAMINATION CERTIFICATE (2391st)

United States Patent [19]

[11] B1 5,113,325

Eisenbraun

[45] Certificate Issued Sep. 13, 1994

[54] LIGHT ASSEMBLY KIT FOR ILLUMINATING AN ARTICLE OF CLOTHING

[75] Inventor: Kenneth D. Eisenbraun, Birmingham, Mich.

[73] Assignee: Eisenbraun Reiss Inc., Troy, Mich.

Reexamination Request:
No. 90/002,804, Jul. 29, 1992

Reexamination Certificate for:

| | |
|---|---|
| Patent No.: | **5,113,325** |
| Issued: | **May 12, 1992** |
| Appl. No.: | **739,299** |
| Filed: | **Aug. 1, 1991** |

[51] Int. Cl.[5] ..... F21L 15/08

[52] U.S. Cl. ..... 362/103; 362/252; 362/800; 362/806

[58] Field of Search ..... 362/103, 108, 800, 804, 362/104

[56] References Cited

U.S. PATENT DOCUMENTS

| | | | |
|---|---|---|---|
| 4,076,976 | 2/1978 | Fenton | 362/104 |
| 4,164,008 | 8/1979 | Miller et al. | 362/806 |
| 4,215,388 | 7/1980 | Remann | 362/104 |
| 4,823,240 | 4/1989 | Shenker | 362/108 |
| 4,912,608 | 3/1990 | Lee | 362/104 |

*Primary Examiner*—Richard R. Cole

[57] ABSTRACT

A light illuminating kit assembly 12 is installable on a garment 10 for illuminating and enhancing a graphics illustration 16 as printed on the exterior surface of the garment 10. The kit assembly includes a central actuation unit 26 having a plurality of wires 24 connecting the central actuation unit with a plurality of light emitting diodes 20. The central actuation unit has a control circuit 30 and a power supply 32 connected thereto via a switch 35. The LED's, when installed through apertures in the shirt, can be flashed ON and OFF in a desired pattern to enhance the illustrations 16.

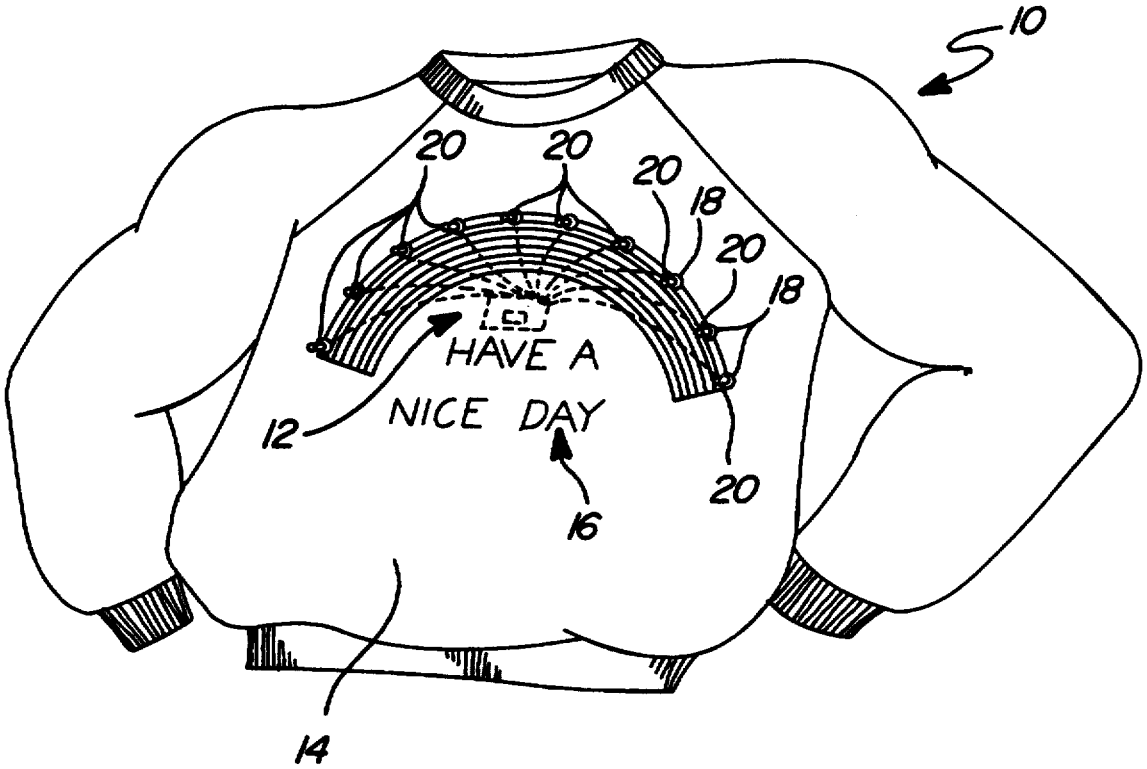

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-12 are cancelled.

* * * * *